US007849927B2

(12) United States Patent
Herrera

(10) Patent No.: US 7,849,927 B2
(45) Date of Patent: Dec. 14, 2010

(54) RUNNING BORE-LINING TUBULARS

(75) Inventor: Derek F. Herrera, Aberdeen (GB)

(73) Assignee: Deep Casing Tools Ltd., Aberdeen (GB)

( * ) Notice: Subject to any disclaimer, the term of this patent is extended or adjusted under 35 U.S.C. 154(b) by 128 days.

(21) Appl. No.: 12/146,491

(22) Filed: Jun. 26, 2008

(65) Prior Publication Data

US 2009/0159281 A1 Jun. 25, 2009

Related U.S. Application Data

(63) Continuation of application No. PCT/GB2007/002874, filed on Jul. 30, 2007.

(51) Int. Cl.
*E21B 29/00* (2006.01)

(52) U.S. Cl. ..... 166/376; 175/92

(58) Field of Classification Search ..... 166/380, 166/376; 175/57, 92, 107
See application file for complete search history.

(56) References Cited

U.S. PATENT DOCUMENTS

| | | | | |
|---|---|---|---|---|
| 2,753,941 | A * | 7/1956 | Hebard et al. | 166/123 |
| 4,227,584 | A * | 10/1980 | Driver | 175/95 |
| 4,576,242 | A * | 3/1986 | Mundell | 175/107 |
| 4,616,719 | A * | 10/1986 | Dismukes | 175/94 |
| 4,721,172 | A * | 1/1988 | Brett et al. | 175/26 |
| 5,197,553 | A * | 3/1993 | Leturno | 175/57 |
| 6,401,820 | B1 | 6/2002 | Kirk et al. | |
| 2004/0226751 | A1 | 11/2004 | McKay et al. | |
| 2005/0183892 | A1 | 8/2005 | Oldham et al. | |
| 2005/0199426 | A1 | 9/2005 | Smith et al. | |
| 2005/0236187 | A1 | 10/2005 | Chen et al. | |
| 2008/0060846 | A1 * | 3/2008 | Belcher et al. | 175/25 |
| 2010/0032170 | A1 * | 2/2010 | Howett et al. | 166/383 |

FOREIGN PATENT DOCUMENTS

| | | | |
|---|---|---|---|
| WO | WO 96/28635 | A | 9/1996 |
| WO | WO 01/42617 | A | 6/2001 |
| WO | WO 01/98621 | A | 12/2001 |
| WO | WO 2004/070159 | A | 8/2004 |
| WO | WO 2005/083226 | A | 9/2005 |

OTHER PUBLICATIONS

Tarr, B. et al., "Casing While Drilling . . . ", World Oil, vol. 22, No. 10, Oct. 1999, Gulf Publishing Co., Houston, TX.

* cited by examiner

*Primary Examiner*—David J Bagnell
*Assistant Examiner*—Catherine Loikith
(74) *Attorney, Agent, or Firm*—Adenike A. Adebiyi; Richard A. Fagin

(57) ABSTRACT

A method of running a tubular string into a wellbore comprises running a bore-lining tubular string into a wellbore substantially without rotation, while rotating a cutting structure at a distal leading end of the tubular string. Other methods provide for rotation of the string and the provision of a non-rotating stabiliser towards the leading end of the string.

14 Claims, 6 Drawing Sheets

FIG. 5A
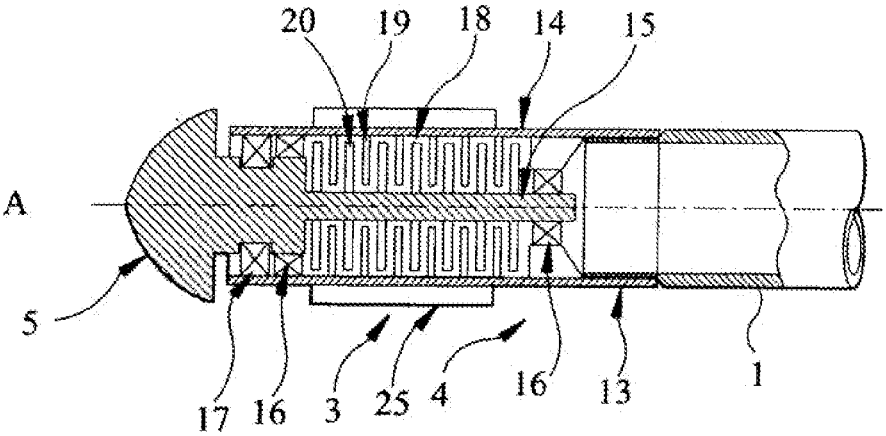
FIG. 5B
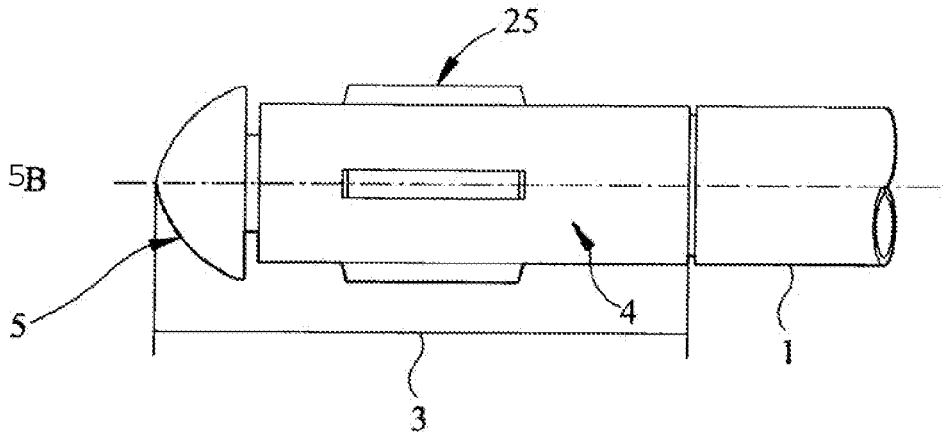
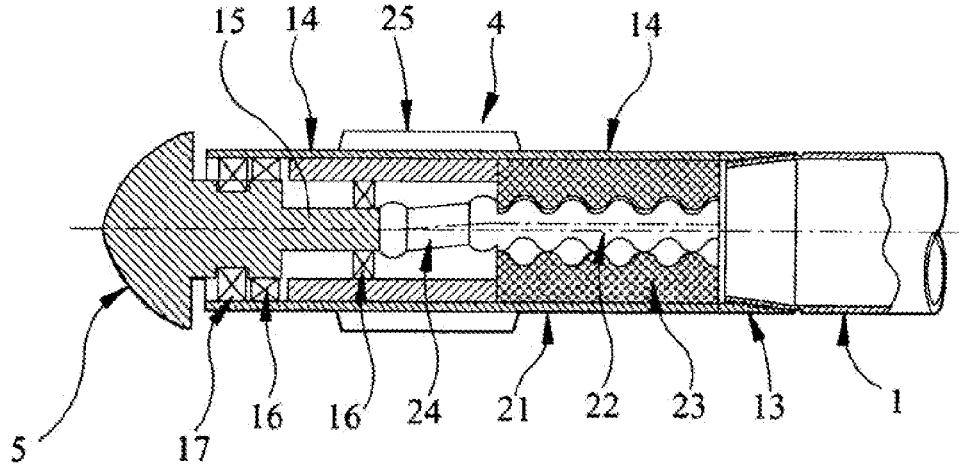
FIG 6 a

RUNNING BORE-LINING TUBULARS

CROSS REFERENCE TO RELATED APPLICATIONS

This is a continuation of International Application No. PCT/GB2007002874 filed on Jul. 30, 2007, which application claims priority from British Patent Application No. 0615135.1 filed on Jul. 29, 2006.

STATEMENT REGARDING FEDERALLY SPONSORED RESEARCH OR DEVELOPMENT

Not Applicable.

BACKGROUND OF THE INVENTION

1. Field of the Invention

This invention relates to running bore-lining tubulars, and in particular to running tubulars into wellbores drilled, for example, to access sub-surface hydrocarbon-bearing earth formations.

2. Related Art

In the oil and gas exploration and production industry, wellbores are drilled from the Earth's surface to access sub-surface hydrocarbon-bearing formations. These bores are typically completed by being lined with metal tubulars, which are generally known as casing and together form a tubular string. The tubular string may be suspended or hung from the Earth's surface and the annulus between the exterior of the casing and the surrounding interior wall of the bore wall is typically filled and sealed with cement ("cased hole completion"). In some wellbore configurations, the drilled hole is left open at the reservoir section such that other tubulars, generally known as liners, can be suspended or hung from the lower end of a string of casing and pass through the portion of the wellbore that intersects the hydrocarbon-producing formations. As with casing, in a liner completion, the annulus between the liner and the wellbore wall may be sealed with cement, and the liner and cement subsequently perforated to provide a fluid flow path between the liner bore and the surrounding Earth formations. In other cases, a tubular string may comprise expandable tubulars which are run into a bore through existing casing and then radially, plastically expanded to a larger diameter below the existing casing to produce a lined bore of substantially constant diameter, known as "mono-bore". Other tubular strings may comprise sand screens which are in effect tubular filters and which may be placed across formations which would otherwise produce large volumes of sand or other solid particulate material with the oil or gas. Such sand screens may also be radially plastically expandable.

A more recent innovation of a tubular string may comprise sections of tubulars welded together at surface to form one continuous string, substantially without threaded connectors.

In a typical conventional tubular string, large numbers of casing sections or "joints" are joined together end to end by typically threaded connectors to form the "string", and the string is lowered ("run") into the wellbore without rotation. The leading end of the casing string is run "barefoot" in many wells or provided with a profiled nose or "shoe". Centralisers may be affixed to the exterior of the casing at selected intervals along the string to centralise the casing in the wellbore to facilitate cementing. However, running casing strings into wellbores is often difficult, and it is not unusual for a casing string not to reach the desired depth on the first run. In such event, the string must be withdrawn and the wellbore re-drilled or otherwise cleaned to remove the obstructions that may have prevented the casing from reaching the desired depth in the wellbore on the first run. Obstructions encountered by a tubular string may include beds of drill cuttings lying on the low side of an inclined bore, ledges, swelling formations, partial or complete borehole collapses, or other borehole discontinuities.

With a view to overcoming these difficulties there have been a number of proposals to provide casing shoes or wash down shoes with hydraulic jets and with cutting blades, and then to rotate the casing string as it is lowered into the bore. These various apparatus and methods have been effective in some instances, however conventional casing and casing connectors are not generally well suited to withstand applied torques, and there are also challenges in providing drive arrangements on drilling or workover rigs capable of handling larger diameter casing. There are also many forms of tubulars which are even less well suited to transferring torque, such as sand screens or slotted expandable tubulars. Furthermore some types of downhole strings by the nature of their design and construction absolutely require first time installation, such as expandable and welded downhole strings.

In a separate and related aspect of the process of drilling sub-surface wellbores from the Earth's surface, and specifically when wellbores are to be drilled under the seabed, a tubular known as a conductor pipe is initially run into the seabed from a platform, jack-up rig, semi-submersible or the like having the purpose of supporting the casing run into the subsequently drilled wellbore. Typically, the conductor is run through a slot in the platform or rig until refusal takes place (meaning until the conductor stops sinking into the seabed under its self weight). Typically refusal takes place at a depth above the required depth to which the conductor should be placed and as a result a pile driver is generally used to drive the conductor to its required depth or until refusal. This pile driving operation can take several days of rig time and thus constitutes an economic cost for the operation.

It is among the objectives of embodiments of the present invention to provide a means of overcoming obstructions encountered by a tubular string while being run into the wellbore which does not rely on the torque capacity of the tubular string, providing rotational drive arrangements on rigs and that allows tubular strings to be run to the desired depth in a timely and economic manner.

It is among the objectives of other embodiments of the present invention to provide a means of placing a conductor at the desired depth in a more timely and economic fashion than is possible using conventional methods.

SUMMARY OF THE INVENTION

One aspect of the invention is a method of running a tubular string into a wellbore. A method according to this aspect of the invention includes running a bore-lining tubular string into a wellbore substantially without rotation, while rotating a cutting structure at a distal leading end of the tubular string.

Another embodiment of this invention is a method of running a tubular string into a wellbore. A method according to this aspect of the invention includes running a bore-lining tubular string into a wellbore substantially without rotation, while rotating and or vibrating a jetting and or cutting structure at a distal leading end of the tubular string.

A further aspect of the invention is an apparatus for use in running a bore-lining tubular into a bore, the apparatus including: a cutting structure adapted for mounting on the distal leading end of a bore-lining tubular such that the cutting structure is rotatable relative to the bore-lining tubular.

These aspects of the present invention can facilitate the running of bore-lining tubulars such as casing, liner, welded string, sand screens and conventional or expandable completions without requiring rotation of the tubulars, but with the advantage of the provision of a rotatable cutting structure on the distal leading end of the tubular string.

The cutting structure may be coupled to a drive unit, which drive unit may comprise at least one of a motor, a drive shaft, a gearbox or other torque transfer device, bearing elements and a connection by which the apparatus may be coupled to the tubular string.

A further aspect of the present invention relates to an apparatus which includes a cutting structure and at least one of a motor, a drive shaft, bearing elements, a gearbox or other torque transfer device, and a connection for coupling the apparatus to a supporting tubular string, which together provide the means and power to rotate the cutting structure, wherein at least part of the apparatus is "sacrificial", that is at least part of the apparatus remains in its run-in location in the wellbore after placement of the tubular string is achieved.

In the various aspects of the invention the apparatus may be adapted to be coupled to the supporting tubular string using threaded connections, and elements of the apparatus may be threaded to one another, and may be adapted to be coupled together as an inline assembly. Of course other forms of connection may be utilised.

In certain aspects of the invention, the apparatus or elements of the apparatus may adapted to be pumped, dropped or otherwise run into a tubular. The apparatus may be adapted to engage with the tubular or with elements of the apparatus which are already coupled or connected to the tubular. The engagement arrangement may take any appropriate form or may be a lock, a bayonet fitting or a J-lock or other arrangement which permits selective movement. The cutting structure may be connected to the tubular as the tubular is run into the bore, or may be subsequently run into the tubular. The cutting structure may have a first retracted configuration in which the structure may describe a diameter smaller than the outer diameter of the tubular, or a diameter smaller than the inner diameter of the tubular if the cutting structure is to be run into the tubular. The cutting structure may include spring-loaded elements or may be actuated to assume an extended configuration by fluid pressure, weight or some other means. The cutting structure may be initially retained in the retracted configuration by any suitable arrangement, such as by shear bolts or by relative movement of parts of the apparatus.

Thus the apparatus suggests a method whereby if a tubular or string is not in the first instance landed at target depth the operator has the possibility of pumping or otherwise running in a drive unit or other apparatus which may be a sacrificial self locking drilling assembly which can be remotely actuated to clear away obstructions so as to enable the tubular string to get to bottom.

The drive unit may be fluid actuated, by fluid flow through the tubular, allowing the unit to be pumped in to the bore with no connection to surface being required. Alternatively, the drive unit or other elements may be run in on an elongate support, such as wireline or coiled tubing cutting. This permits an operator to transfer power via the support, for example the motor may be an electric motor. The provision of a support for the drive unit also facilitates retrieval of elements of the apparatus from the tubular, reducing the number of sacrificial elements that are required.

A further aspect of the invention relates to an apparatus which includes at least one of a sacrificial cutting structure, a sacrificial motor, a sacrificial drive shaft, sacrificial bearing elements, a sacrificial gearbox or other torque transfer device and a sacrificial connection to a supporting bore-lining tubular, at least one if which is drillable, meaning that the drillable elements of the apparatus are constructed of materials or are in a configuration such that the apparatus may be drilled out of the wellbore by a rock drilling tool, or otherwise removed, in a timely fashion.

As used herein, the term "drillable" encompasses an element which is at least partially removable by drilling, is breakable or shatterable, or degradable by exposure to selected materials, for example a particular fluid or chemical pumped into the bore.

Some or all of the elements of the apparatus may be drillable.

A further aspect of the invention relates to an apparatus which includes at least one of a sacrificial cutting structure, a sacrificial motor, a sacrificial drive shaft, sacrificial bearing elements, a sacrificial gearbox or other torque transfer device and a sacrificial connection to a supporting bore-lining tubular, which apparatus is limited in its functional capability to opening up or reaming restricted sections of an existing wellbore to achieve a desired and pre-set dimension and therefore does not have the capability to drill into the formation to create a wellbore.

A further aspect of the invention relates to an apparatus which includes at least one of a sacrificial cutting structure, a sacrificial motor, a sacrificial drive shaft, sacrificial bearing elements, a sacrificial gearbox or other torque transfer device and a sacrificial connection to a tubular, built to represent a more economical alternative, when compared with available technology in downhole cutting structures and motors designed to drill into formations to create wellbores.

A further aspect of the invention relates to a method of casing, liner, or conductor placement into the seabed. A method according to this aspect of the invention includes running a conductor into the seabed to its required depth substantially without rotation, while rotating a cutting structure disposed at a distal leading end of the conductor.

When subsequently the wellbore drilling operation begins, sacrificial apparatus including at least one of a sacrificial cutting structure, a sacrificial motor, a sacrificial drive shaft, sacrificial bearing elements, a sacrificial gearbox or other torque transfer device and a sacrificial connection to the conductor may be drilled out from its run-in location at the distal leading end of the conductor using a rock drilling tool and drilling of the wellbore may proceed.

Another aspect of the present invention relates to a method of running a bore-lining tubular string, the method including the step of obtaining information from sensors associated with at least one of the string and the well and transmitting said information to surface as the string is run into a bore.

It should be understood that the step of obtaining information from sensors associated with the string includes any portion of the string or any associated equipment or assemblies. Also, it should be understood that the step of obtaining information from sensors associated with the well includes any portion of the well, including defined annuli, or associated equipment or assemblies.

The method may comprise the step of obtaining information from both the string and the well.

The information obtained may be compared to predictive models and utilised to adjust parameters to assist in optimising performance.

A related aspect of the invention relates to downhole apparatus adapted for mounting in a bore-lining tubular string, the apparatus including at least one sensor and a transmitter for transmitting information obtained by the sensor towards surface.

The apparatus may be provided for use with or in combination with an otherwise conventional bore-lining tubular string, or may be provided in combination with one of the aspects of the invention described above. The apparatus may be sacrificial or disposable, in that the apparatus is provided with the intention that the apparatus remain in the bore with the string and may even be drilled through if the bore is drilled beyond the end of the string. Alternatively, at least some elements of the apparatus may be retrievable, for example by a fishing operation using wireline or coiled tubing. Thus, for example, after a string has been run in to the required depth, the apparatus may be retrieved to surface for reuse. In other embodiments, elements of the apparatus may remain in the bore and operate to provide information subsequent to the string-running operation.

The sensors may take any appropriate form and may be utilised to obtain any appropriate form of information. The sensors may measure bore parameters indicative of bore inclination or azimuth, formation parameters, or bore fluid parameters. Alternatively or in addition, the sensors may measure or sense parameters relating to the string or to a shoe, reaming structure or other element of the string, including but not limited to reamer wear, tubular stress or strain, or casing connector condition.

The apparatus may be provided towards the distal end of the string, and may be mounted on or close to, or otherwise operatively associated with a bottom hole assembly associated with the string.

The sensors and transmitters may utilise elements of existing measurement and logging tools or devices, such as are currently utilised in, for example, MWD or LWD operations, or in wireline run logging tools.

Information gathered by the sensors may be transmitted to surface in any appropriate form or manner, for example by control line, via cabling, optical fibre, via the string, or via bore fluid. Thus, communication may be achieved by, for example, mud pulse telemetry, wireless acoustic, or EM. The information may be transmitted in real time, or may transmitted at intervals or in discrete packets.

A still further aspect of the present invention relates to apparatus for use in running a bore-lining tubular string into a bore, the apparatus including a non-rotating stabiliser adapted for location adjacent the distal end of the string.

The stabiliser is adapted to be mounted on the string such that the string may be rotated relative to the stabiliser. Typically, when the string, or at least the distal end of the string, is rotated relative to the stabiliser, which is held against rotation by contact with the bore wall.

Such a stabiliser is useful when, for example, a bore-lining tubular string is being run through into a collapsed or partially collapsed section of bore. Such strings may tend to deviate from the bore axis on encountering such a collapsed section, particularly where the bore intersects a softer formation. This problem may be exacerbated by the provision of an eccentric casing or liner shoe, where the leading end of the shoe is offset from the string axis. The tendency to deviate from the intended bore trajectory will be minimised by the presence of the stabiliser.

The stabiliser may be provided in combination with a shoe, which shoe may include cutting or reaming elements. The stabiliser may be adapted for use in combination with a non-rotating The stabiliser may be adapted to be selectively configured to rotate with the string, for example the apparatus may include a clutch arrangement, such as described in U.S. Pat. No. 7,159,668, the disclosure of which is incorporated herein by reference in its entirety. The clutch arrangement may be adapted to lock when the string is pulled back in the bore, such that the stabiliser may be utilised to ream tight spots.

Another aspect of the present invention relates to a drillable reamer shoe comprising a one-piece body.

The body may comprise aluminium, aluminium alloy or any other suitable material.

This shoe of this aspect of the invention contrasts with conventional drillable shoes, in which a drillable insert is located within a harder shell.

The body may form a guide nose of a shoe assembly.

Wear strips or bands may be provided on the exterior of the body. In one embodiment hard material, or elements of hard material, such as cutting carbide, is fabricated onto the body. The hard material may be protected by an appropriate wear material, such as a high velocity oxy-fuel (HVOF) process applied wear material.

The shoe may include cutting or reaming blades. The blades may extend solely axially, or may be inclined, for example part helical. The blades may integral with the body, and formed from the same piece of material as the body. The leading ends of the blades may comprise wear-resistant or cutting material.

Where the shoe is adapted to be rotated relative to the string, the shoe body and a power shaft for transmitting drive to the shoe may be one-piece.

The shoe may be provided in combination with a stabiliser in accordance with another aspect of the present invention.

BRIEF DESCRIPTION OF THE DRAWINGS

These and other aspects of the present invention will now be described, by way of example, with reference to the accompanying drawings, in which:

FIGS. 5*a* and 5*b* show details of an embodiment of an apparatus for use in running a bore-lining tubular string into a wellbore as illustrated in FIGS. 1 to 4;

FIGS. 6A and 6B show other embodiments of an apparatus for use in running a bore-lining tubular string into a wellbore;

DETAILED DESCRIPTION

Figure 1:
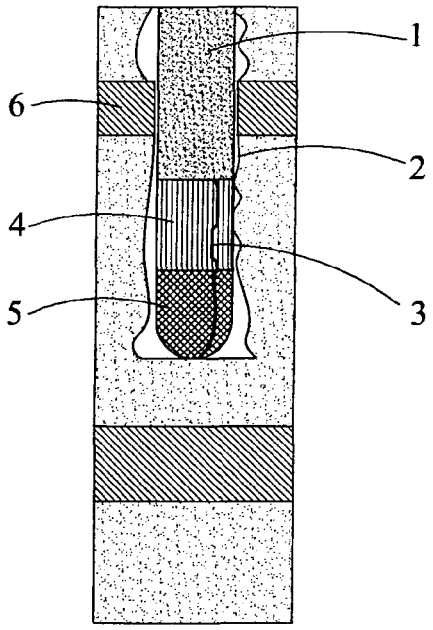
FIGS. 1 to 4 are schematic illustrations of a method of running a bore-lining tubular string into a wellbore in accordance with an embodiment of the present invention.

Reference is first made to FIGS. 1 to 4 of the drawings. FIG. 1 illustrates a 17½" outer diameter casing or tubular 1 which has been run into a 23" diameter drilled wellbore 2 using an apparatus 3 in accordance with an embodiment of the present invention. The apparatus 3 includes a drillable drive unit 4 and a drillable cutting structure 5. While running in the casing 1, drilling fluid is circulated through the casing 1. The drilling fluid passes through the drive unit 4 to rotationally drive the cutting structure 5. This allows the casing 1 to be run in, without rotation of the casing 1, through an unstable formation 6 which might otherwise prevent advancement of the casing 1, requiring the casing 1 to be run in to only partial depth, or requiring the casing 1 to be removed from the bore 2 and the unstable formation 6 re-drilled by conventional rock-drilling means.

Figure 2:
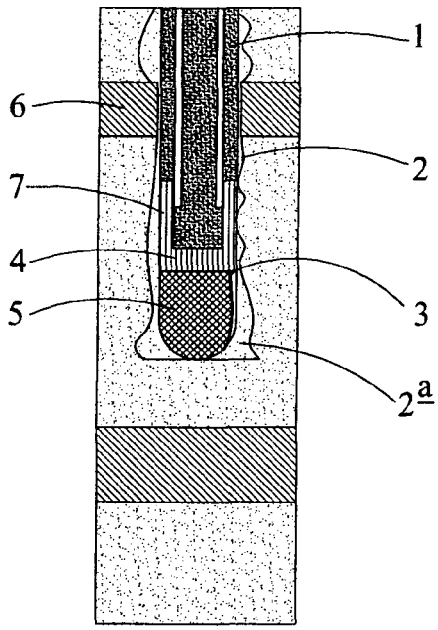

The casing 1 is then cemented in the wellbore 2 with cement 2*a*, as illustrated in FIG. 2, and a 12¼" diameter drill bit assembly 7 run into the bore 2 to drill out the apparatus 3 and extend the bore beyond the end of the casing 1. The apparatus 3 is adapted to facilitate drilling out, by virtue of one or all of the following features: its limited length (up to 8 ft or up to 12 ft or up to 15 ft); its material composition; and its configuration which locks rotatable parts against rotation induced by the drill bit 7.

Figure 3:
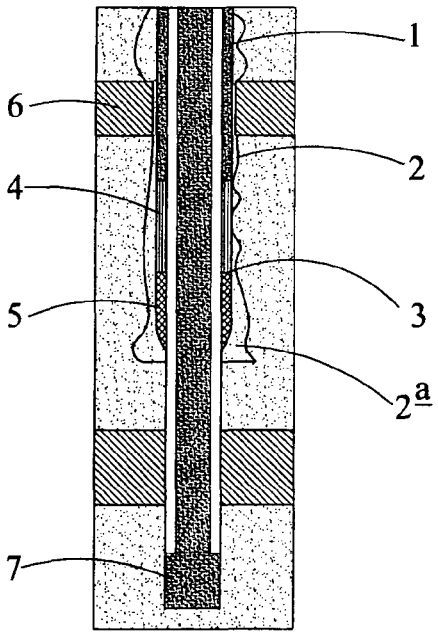
Figure 4:
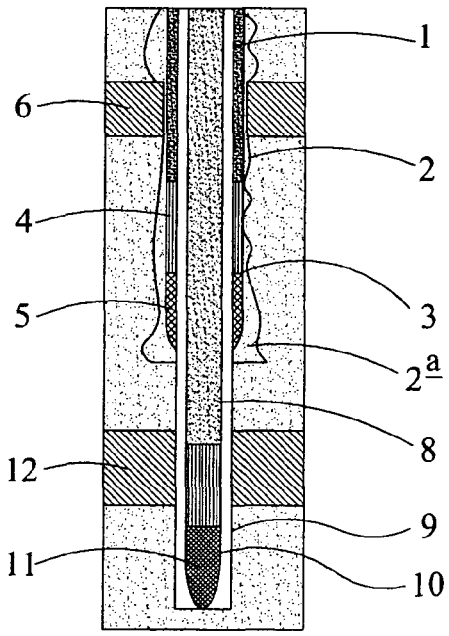

After the wellbore 2 has been extended to a target depth, as illustrated in FIG. 3, the drill bit 7 is withdrawn. A 9⅝" outer diameter casing string 8 is assembled and run through the wellbore 2 and into the extended wellbore 9, as illustrated in FIG. 4, with an apparatus 10 in accordance with an embodiment of the invention located on the distal leading end of the 9⅝ inch diameter casing string 8. As with the previous 17½ inch outer diameter casing string 1, the operation of the cutting structure 11 allows the 9⅝ inch diameter casing string 8 to safely pass through an unstable formation 12 and be run in to target depth before being cemented in the bore 9.

Reference is now made to FIGS. 5*a* and 5*b* of the drawings, which illustrate details of the apparatus 3.

As noted above, the apparatus 3 is adapted for mounting on the distal leading end of a wellbore-lining tubular string 1, such as a casing string, and as such incorporates an appropriate end connector 13. The apparatus 3 further comprises the drive unit 4, and the rotating cutting structure 5, which in this embodiment is in the form of a cutting bit.

The drive unit 4 comprises a housing 14, a shaft 15 which is supported in the housing 14 radially by radial bearings 16 and supported axially by thrust bearings 17, a turbine arrangement 18 which consists of a stack of individual turbines, each turbine comprising stator blades 19 attached to the housing 14 and rotor blades 20 attached to the shaft 15. The cutting structure 5 is fixed to the drive shaft 15, and indeed in a preferred embodiment the cutting structure 5 and shaft 15 are formed from a single piece of metal, although in other embodiments the a metal cutting structure may be coupled to a polymeric shaft. Drilling fluids which have been pumped down the tubular string 1 into the drive unit 4 at an appropriate pressure and velocity pass through the turbine arrangement 18 and thereby cause the driven turbine wheel 20, the drive shaft 15 and the cutting structure 5 to rotate. If necessary a fluid accelerator may be provided upstream of the turbine arrangement.

The housing 14 may have an outside diameter equal to or less than that of the tubular string 1 to facilitate run-in when attached to the distal leading end of the tubular string 1 and an inside diameter equal to or greater than the inside diameter of the tubular string 1 to facilitate a drilling out operation of all components of the drive unit 4 which are located inside the housing 14.

The housing 14 may have an external stabilising feature 25 comprised vanes or blades which are positioned around the circumference of the housing 14 and together define an effective outside diameter equal to or less than the outside diameter of the cutting structure 5. The stabilising feature 25 may be part of or fixed to the housing 14 or, alternatively, may comprise a separate cylindrical element which is free to rotate around the housing 14 but is constrained axially on the drive unit 4.

The cutting structure 5 may be utilised to remove or clear drill cuttings, ledges, swelling formations, wellbore discontinuities or other obstructions in an existing wellbore 2 while the tubular string is being run into the wellbore.

The drive unit 4 may drive the cutting structure 5 continuously or intermittently, for example only when the weight applied to the tubular increases above a predetermined level or under operator control where surveys have highlighted the likelihood of problems, for example the presence of unstable formations in particular regions of the wellbore.

The drive unit 4 and the cutting structure 5 are adapted to remain in the bore with the tubular string 1 once the tubular string 1 has been run-in to the intended depth in the wellbore 2.

The drive unit 4 and the cutting structure 5 may be formed from materials selected to be drillable or otherwise adapted to be broken-up, or, alternatively, chemically dissolved by a solvent, to facilitate the wellbore 2 being drilled through and beyond the lower end of the tubular 1 and the apparatus 3. To this end, the drive unit 4 may comprise parts or portions adapted to break or fail on contact with a drill bit 7 or other structure, or on contact with a chemical solvent. Rotatable parts of the drive unit 4 may include features to lock or otherwise resist rotation when engaged by a rotating drill bit 7 inserted into the interior of the tubular string 1.

The drive unit 4 or parts of the drive unit 4 may be adapted to be lockable, such as by reconfiguring the drive unit 4. For example, the drive unit 4 may be formed from material susceptible to collapse or to otherwise reconfigure on experiencing a particular form or level of load. In one embodiment, an axial mechanical load applied by the drill string 7 or tubular string may collapse the drive unit support member and move rotatable parts of the drive unit 4 into a locked configuration. In other embodiments, engagement of a device, for example a cement plug, dart or ball pumped or dropped into the interior of the tubular string 1 will lock, reconfigure or permit reconfiguring of the drive unit 4 to facilitate drilling the drive unit 4 for removal from the wellbore 2. In one embodiment a device may close the drive unit 4 to fluid flow, allowing creation of an elevated pressure differential across the drive unit 4, causing shear pins or other structures to fail and move part of the drive unit 4 to a locked position.

In other embodiments the drive unit 4 may be configured to be rotatable in one direction but to resist rotation in the ordinary and opposite direction of rotation of a drill bit 7.

In another embodiment the drive unit 4 may be configured such that when a solidifiable or settable material, for example, cement, fills parts of the drive unit 4 and the material solidifies, parts of the drive unit 4 thus resist rotation. In one embodiment, the method to lock rotation of the drive unit 4 may comprise pumping material specifically intended to lock or bind the drive unit 4 or to chemically dissolve part or the entire drive unit 4.

The drive unit 4, the cutting structure 5 or both may comprise a frangible material or materials that will shatter or otherwise break when exposed to a shock load. Such materials may include brittle metals or alloys, such as cast iron, or ceramics, plastics, glass or polymeric materials, or fibre reinforced composite polymeric materials. Alternatively, malleable or readily drillable materials such as aluminium, leaded bronzes or plastics may be used. The drive unit 4, the cutting structure 5 or both may comprise a material or materials adapted to degrade on exposure to certain conditions or materials, for example a particular fluid or cement. Thus, in the latter case, when the tubular string 1 is cemented in the wellbore 2, the exposure of drive unit 4 and cutting structure 5 components to cement may dissolve or weaken the components. The drive unit 4, the cutting structure 5 or both may comprise a material or materials adapted to swell or set on exposure to particular materials, for example an elastomer that swells on exposure to oil or water or a bearing lubricant that sets solid after being exposed to elevated temperature or pressure for a predetermined time period.

The drive unit 4 may be configured to permit fluid bypass such that, for example, cement may be pumped through the tubular string 1 without having to pass through the drive unit 4. The bypass may be actuated by any appropriate means, such as a dart which reconfigures the fluid path through the drive unit 4 or by a control line to surface.

The cutting structure 5 may comprise cutting blades, diamond inserts, ridges, rollers or other structures adapted to crush, mechanically displace or remove material, an example of such cutting structure being a roller cone. However, other embodiments may include jets of fluid or other non-mechanical cutting elements. The cutting structure 5 may comprise any appropriate material including, but not limited to diamond, polycrystalline diamond compact ("PDC") or various carbide compositions such as tungsten carbide or vanadium carbide or combinations thereof. The cutting structure 5 will typically comprise a relatively hard or robust outer part or parts, which may include a casing or shell, and a drillable or otherwise removable inner core.

In one embodiment the cutting structure 5 may be spaced a distance away from the end of the apparatus 3 for example positioned to the rear of a rotating or non-rotating guide shoe. Thus, the apparatus 3 may be provided in combination with a guide shoe which may be eccentric or non-eccentric. The cutting structure 5 may comprise an annular body and cutting members arranged circumferentially around the body. The cutting members may thus perform a reaming function.

In one embodiment the cutting structure 5 may comprise a rotating shoe forming the distal leading end of the tubular string 1.

The drive unit 4 may be located within the cutting structure 5. In one embodiment the cutting structure 5 may be mounted directly to or integral with the drive unit 4; such an embodiment may comprise only one moving part.

In other embodiments the drive unit 4 may be linked to the cutting structure 5 via gearing or any other torque transfer device which may function to change the rotational velocity of the cutting structure 5 relative to the rotational velocity of the shaft 15 of the drive unit 4.

In other embodiments the cutting apparatus 3 may include an arrangement for modifying fluid flow through the tubular 1, for example accelerating the flow to provide an appropriate input for a fluid actuated drive unit 4.

In other embodiments a number of spaced apart turbine rings may be pinned, or otherwise fixed on a drive shaft. These rings may comprise polymeric collars or rings defining external blades, and may not require provision of stator blades.

Where a solid drive shaft is provided, the outer surface of the shaft may define a bearing surface, and flow passages may be provided through the shaft to allow passage of fluid from a turbine section to jetting nozzles in a shoe.

The drive unit 4 and the cutting structure 5, together the cutting apparatus 3, are designed to have a limited service life. As such, elements of the cutting apparatus 3 such as bearings may experience a degree of wear during operation which, without compensation, could impact on cutting performance. Such variations in performance may be designed in to the limited service life of the cutting apparatus 3, or may be alleviated by provision of a self-centering bearing arrangement, for example a tapered bearing which is translated during the life of the drive unit 4 to accommodate wear.

The cutting apparatus 3 may be adapted to provide a mean time before failure ("MTBF") in service of up to forty hours, up to thirty hours, up to twenty hours, up to fifteen hours or up to ten hours. This contrasts with conventional drilling motor assemblies which typically have an MTBF of more than three hundred hours. Accordingly, the cutting apparatus 3 may be produced using relatively inexpensive materials which do not require the same level of tolerances as conventional drilling assemblies which are designed for long life and at a correspondingly higher cost.

The apparatus 3 may be provided in combination with a float valve.

The cutting structure 5 may be configured to be rotated at generally between 30-100 rpm (revolutions per minute), and may be rotated up to 20,000 rpm, depending on the form of the cutting structure 5 and the form of the drive unit 4.

The drive unit 4 may be adapted to provide a predetermined torque at the cutting structure 5, in some embodiments this may be up to 1500 ft-lbs, in other embodiments this may be up to 3000 ft-lbs or up to 5000 ft-lbs of torque.

In an alternative embodiment of the present invention, shown in FIG. 6A, the drive unit 104 may incorporate a so-called helicoidal positive displacement motor or Moineau motor 21, in which features on the helical shaft 22 cooperate with corresponding features on the stator 23 to define chambers such that movement of fluid through the motor 21 exerts pressure on the chambers that is relieved by relative rotation and torque transmission between the helical shaft 22 and the stator 23. In their relative rotation, the helical shaft 22 rolls on the inside of the stator 23 rotating about an axis displaced from that of the axis of the drive shaft 15. Therefore in this embodiment, the helical shaft 22 is connected to the drive shaft 15 by a universal joint 24 which may be a flexible shaft or an articulated joint. As with the embodiment in FIG. 5, the drive shaft 15 is constrained in its rotation and torque transmission by suitably designed radial bearings 16 and thrust bearings 17. As with the embodiment in FIG. 5, this embodiment is contained in a housing 114 and is coupled to the tubular string 1 via a connection 13.

Figure 6B:
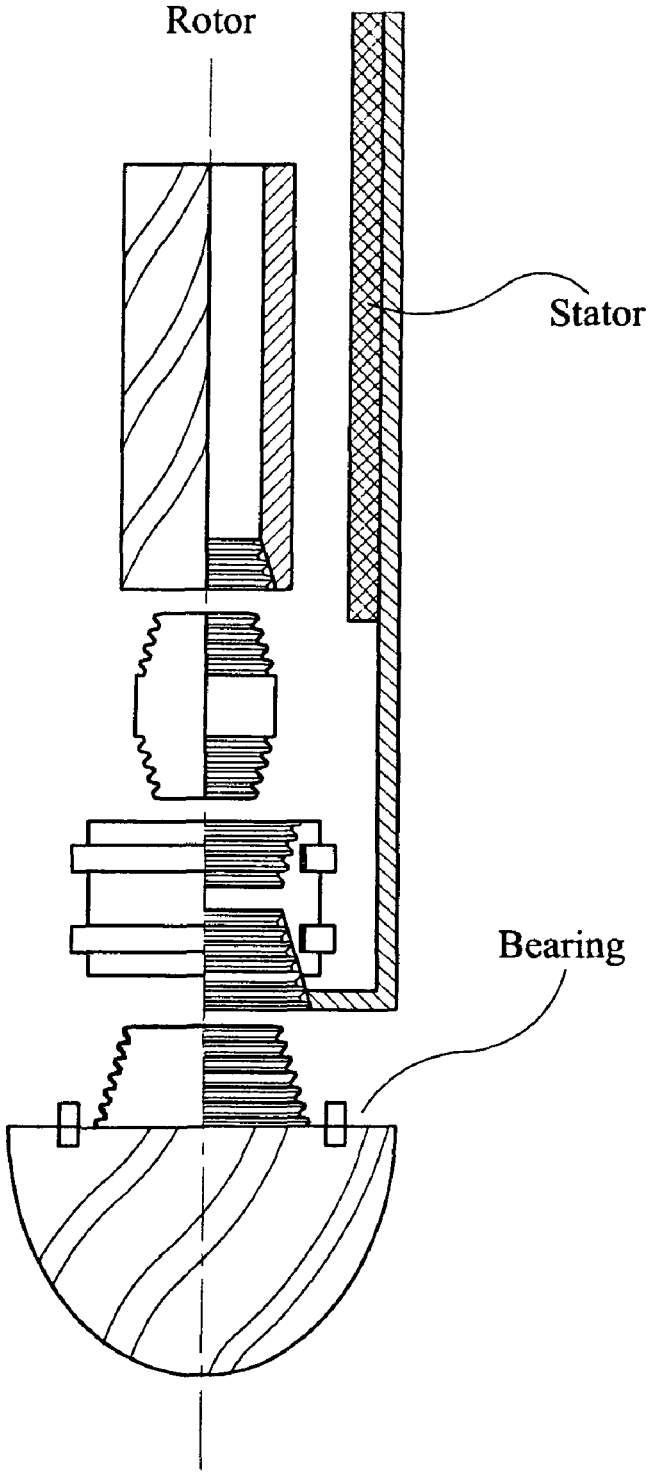

In addition to the embodiments shown in FIGS. 5 and 6A, the drive unit may comprise a fluid actuated motor, for example, a positive displacement motor with flexible vanes, a positive displacement motor with rigid vanes, a peristaltic positive displacement motor, or an edge driven motor. In other embodiments the drive unit may be electrically actuated, electrical power being supplied from surface via control lines or from a local power source, for example electrical cells or a fluid-driven electrical generator, and such an embodiment is illustrated in FIG. 6B of the drawings, in which an external stator cooperates with a tubular fluid-transmitting rotor.

Figure 7:
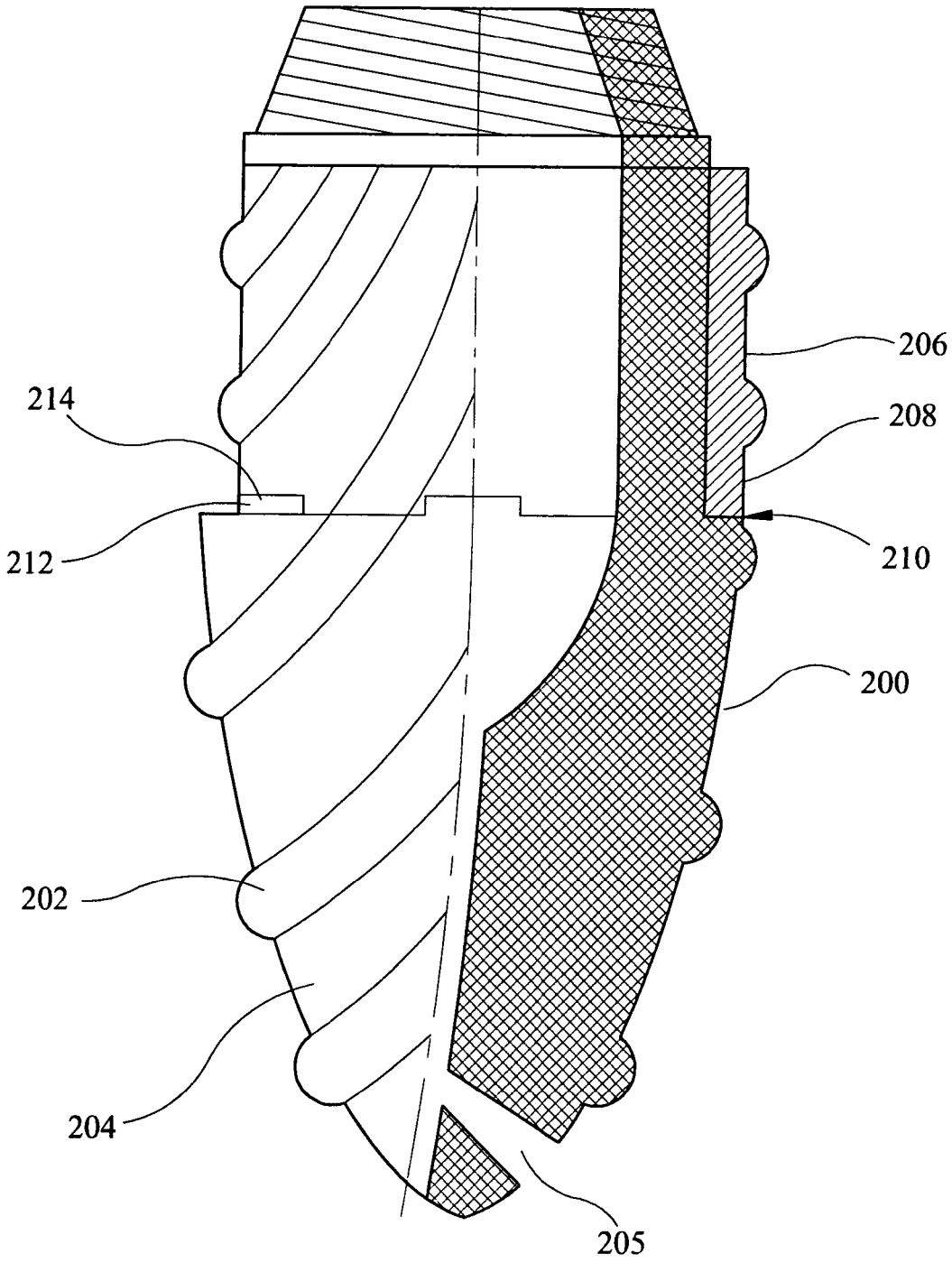
FIG. 7 shows a reaming shoe forming part of a further embodiment of an apparatus for use in running a bore-lining tubular string into a wellbore.

Reference is now made to FIG. 7 of the drawings, which shows a reaming shoe 200 forming part of a further embodiment of an apparatus for use in running a bore-lining tubular string into a wellbore. The shoe 200 features reamer blades 202 of a relatively hard material mounted on a drillable base material 204. The base material 204 tapers to provide an eccentric nose, and defines a number of fluid passages 205. A bladed centraliser 206 is mounted directly behind the reamer shoe 200 (but can be integral on the same sub assembly), and is normally free to rotate relative to the shoe 200. In particular, the centraliser comprises a sleeve 208 which is free to move axially away from the shoe to disengage a clutch arrangement 210 provided between the centraliser 206 and the shoe 200.

The clutch arrangement 210 comprises an arrangement of rectangular teeth 212 on the trailing edge of the shoe 200, which selectively cooperate with corresponding recesses 214 formed in the leading edge of the centraliser sleeve 208. Thus, the centraliser 206 will be free to rotate relative to the reamer shoe 200, and the tubing string on which the shoe 200 is mounted, as the shoe 200 is advanced through a well bore. Thus, the centraliser will normally be "non-rotating", even when an associated downhole motor, as described above, is rotating the shoe 200.

However, if the tubing string is pulled back in the bore, or the centraliser 206 otherwise moved axially towards the shoe 200, the clutch arrangement 210 will engage, such that rotation of the shoe 200 will also cause rotation of the centraliser 206. This arrangement is thus useful to allow reaming of tight spots which occur above or adjacent the shoe 200.

This shoe and centraliser clutch arrangement also has utility in other reaming and drilling applications, and is not limited in its utility or form to the details of the particular embodiment as described above.

A further advantage of having the centralizer close to the reamer shoe is that the centralizer will act as a stabilizer and assist in controlling deviation so as to ensure that the assembly stays true to the original trajectory of the well profile. In one embodiment, one or both of the reamer shoe and the centraliser includes an offsetting arrangement, and the configurations of one or both of the reamer shoe and the centralizer may be selected to change the characteristic. In addition, the centraliser can be constructed to have an outer diameter substantially the same diameter of the reamer shore or hole diameter, depending on application.

The materials used to form the drillable elements may include malleable materials such as zinc, aluminium, aluminium bronze alloys, plastics such as nylons, acetals, brittle materials such as glass, pig iron and the like, and suitable materials among those listed in, for example, EP 1292754 and EP 0721539.

Figure 8:
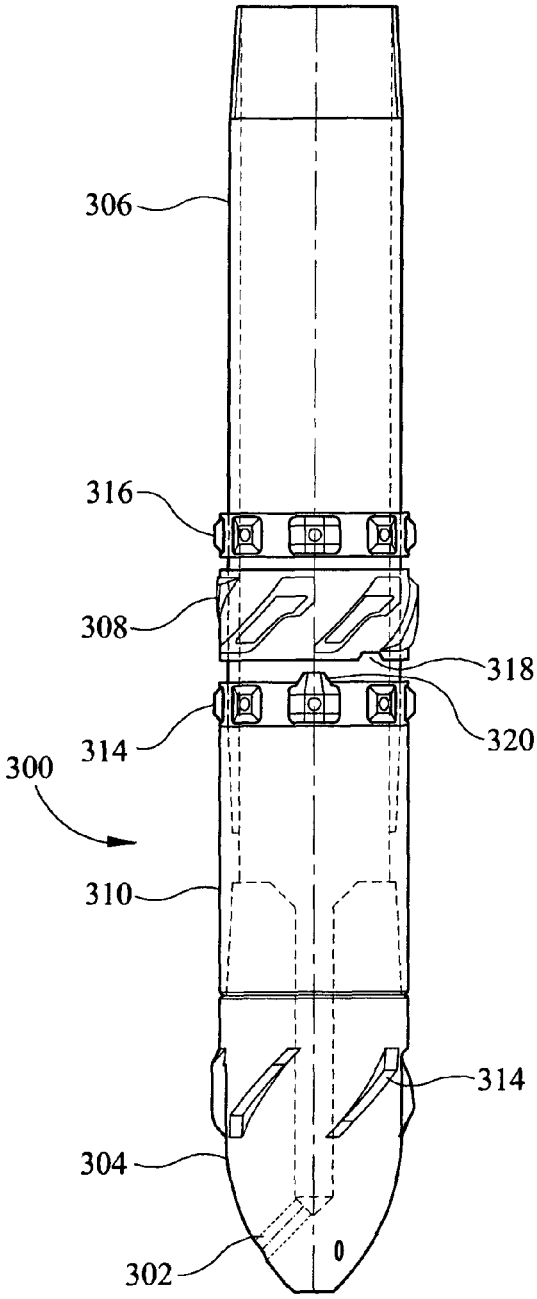
FIG. 8 shows a reamer shoe in accordance with another embodiment of the present invention.
Figure 9:
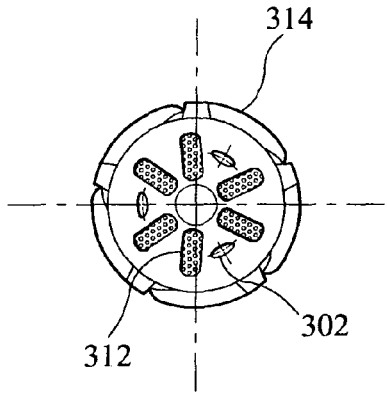
FIG. 9 is an end view of the shoe of FIG. 8.
Figure 10:
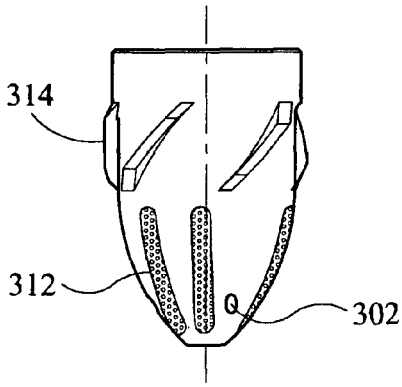
FIG. 10 is a view showing surface detail of the nose of the shoe of FIG. 8.

Reference is now made to FIGS. 8, 9 and 10 of the drawings, which illustrate a reamer shoe 300 in accordance with another embodiment of the present invention.

The shoe 300 is adapted for mounting on the leading end of a string of casing or liner and defines a central through bore which permits fluid to be pumped through the shoe and exit via three equi-spaced jetting holes 302 in the leading end of the shoe.

The shoe comprises three primary body elements: a one-piece guide nose 304, a tubular sleeve 306 providing mounting for a stabilizer 308, and a collar 310 coupling the nose 304 and sleeve 306. The aluminium nose 304 is of one-piece construction and is relatively thick-walled. However, the use of aluminium, or an aluminium alloy, allows the nose to be drilled out relatively easily. The free end of the nose 304 is rounded and tapered and features hard-facing inlaid wear strips 312. Helical cutting blades 314 are provided on the larger diameter portion of the nose, the leading edges of the blades featuring hard-facing material.

The sleeve 306 is relatively thin walled and may be formed of a harder material, such as steel. The stabilizer 308 is mounted on the sleeve 306 between two stop collars 314, 316. The lower or leading edge of the stabilizer 308 defines notches 318 configured to selectively engage with corresponding teeth 320 provided on the lower stop collar 314. When the notches 318 and the teeth 320 engage the stabilizer is held against rotation relative to the sleeve 306, and thus may be rotated together with the sleeve 306 to provide a cutting or reaming action. When spaced from the collar 314, the stabilizer 308 is free to rotate relative to the sleeve 306. Thus, when the string and the shoe 300 are rotated in a bore the stabilizer 308 will tend not to rotate.

While the invention has been described with reference to a limited number of embodiments, those skilled in the art pertaining to the invention will readily devise other embodiments, which may utilise alternative materials, within the scope of the present invention.

Figure 11:
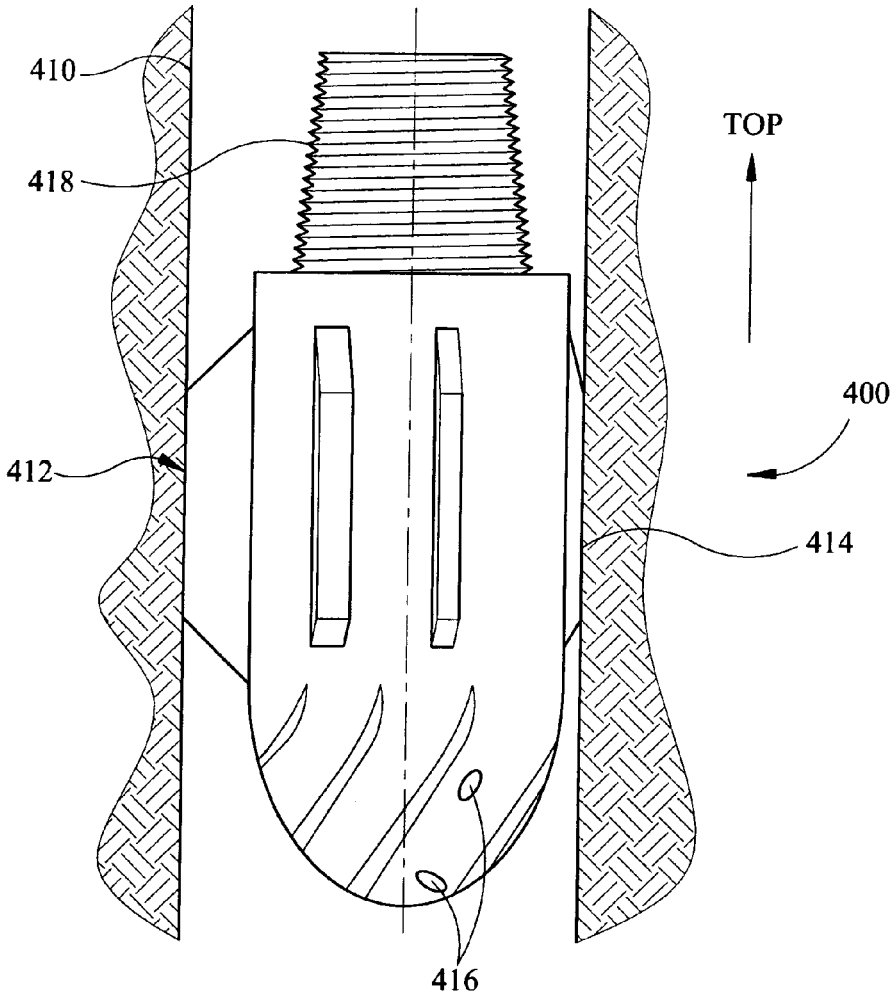
FIG. 11 is a side view of a shoe in accordance with another embodiment of the present invention.
Figure 12:
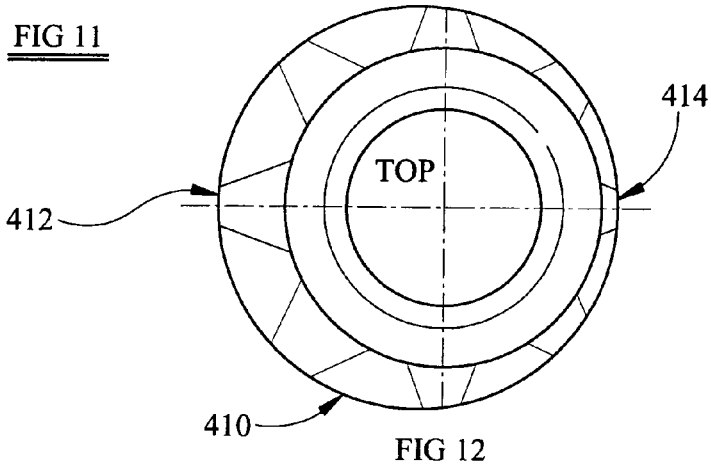
FIG. 12 is a cross-sectional plan view of the shoe of FIG. 11.

For example, in alternative embodiments of the present invention, and as shown in FIGS. 11 and 12 of the drawings, a reamer shoe may be provided which is configured to provide an elliptical drilling action, that is, where the drilling radii extends in one direction beyond the cutting diameter of the remainder of the bit. In one embodiment, this is achieved through the use of a bi-centre cutting tool, structure or reamer bit 400. The provision of a bi-centre cutting structure 400 permits, on rotation, the reamer bit 400 to create an "oversized" hole 410. As shown most clearly in FIG. 12, the bit 400 comprises one or more blades 412 which have a greater offset than the other blades 414 such that on rotation a bore with a larger diameter may be drilled. The bit 400 may further comprise circulating ports 416. The shoe may further comprise a threaded or other suitable connector 418. It will be recognised that the apparatus of the present embodiment may be utilised in combination with the apparatus described hereinabove.

Thus, embodiments of the present invention may provide an apparatus wherein one or more components of the assembly are drillable and/or disposable, for example, but not exclusively, the rotor, power shaft, bearing, bit or the like.

Apparatus according to embodiments of the present invention further include a reamer shoe which may be coupled to a conventional downhole motor or Measurement While Drilling (MWD) system, for example, but not exclusively, a downhole mud motor. Thus, the motor and/or MWD system may or may not be retrievable.

Output from downhole sensors may be utilised together with predictive models of the bore to adjust surface variables including, for example, but not exclusively, pump rates, speed of running into the hole, slack off, or other surface controlled variables. For example, output from the sensors may be fed back and a comparison made with the predicted parameters, this permitting a change in parameters to assist in optimising performance.

The invention claimed is:

1. An apparatus (3) for use in running a bore-lining tubular string into a bore, comprising:

a cutting structure (5);

a drive unit (4) coupled to the cutting structure (5) and operable to rotationally drive the cutting structure (5), wherein the drive unit and cutting structure comprise at least one of a frangible, drillable, soluble, and degradable portion, wherein the drive unit is completely removable from the bore by the action of drilling, dissolving or degrading; and an end connector (13) coupled to the drive unit (4) and adapted for connection to the bore-lining tubular.

2. The apparatus of claim 1, wherein the drive unit (4) comprises a housing (14) and a drive shaft (15) rotatably supported within the housing (15).

3. The apparatus of claim 2, wherein the drive unit (4) further comprises a turbine arrangement (18) attached to the drive shaft (15).

4. The apparatus of claim 3, wherein the turbine arrangement comprises a plurality of stator blades (19) attached to the housing (14) and a plurality of rotor blades (20) attached to the drive shaft (15).

5. The apparatus of claim 4, wherein the cutting structure (5) is fixed to the drive shaft (15).

6. The apparatus of claim 2, wherein the drive unit (4) further comprises a motor (21) having a helical shaft (22 in FIG. 6A) and stator (23), wherein the helical shaft (22) rolls inside of the stator (23).

7. The apparatus of claim 6, wherein the helical shaft (22) is coupled to the drive shaft (15) via a flexible joint.

8. The apparatus of claim 2, further comprising an external stabilizing feature (25) positioned around a circumference of the housing (14).

9. The apparatus of claim 8, wherein the external stabilizing feature (25) and housing (14) have an effective outside diameter substantially equal to or less than an outside diameter of the cutting structure (5).

10. A downhole apparatus, comprising:

a bore-lining tubular string;

a cutting structure;

a drive unit coupled to the cutting structure and operable to rotationally drive the cutting structure, wherein the drive unit and cutting structure comprises a frangible, readily-drillable, soluble, or degradable portion, wherein the drive unit is completely removable from the tubular string by action of drilling, dissolving or degrading; and an end connector for coupling the drive unit to an end of the bore-lining tubular string.

11. A method of running a bore-lining tubular string into a bore, comprising:

attaching an apparatus to a leading edge of the bore-lining tubular string, the apparatus comprising a cutting structure and a drive unit coupled to the cutting structure and operable to rotationally drive the cutting structure, wherein the drive unit and cutting structure comprises a frangible, readily-drillable, malleable, soluble, or degradable portion;

running the bore-lining tubular string with the attached apparatus into the bore; and drilling out the apparatus.

12. The method of claim 11, further comprising circulating drilling fluid through the bore-lining tubular string while running the bore-lining tubular string into the bore.

13. The method of claim 12, further comprising using downhole sensors together with predictive models of the bore to adjust surface variables.

14. The method of claim 11, further comprising cementing the bore-lining tubular string to the bore.

* * * * *